United States Patent [19]

LoRusso

[11] Patent Number: 4,966,735

[45] Date of Patent: Oct. 30, 1990

[54] NON-LEAKING VENTURI CARBURETOR

[76] Inventor: Michael LoRusso, 9 Woodland Ter., Yonkers, N.Y. 10701

[21] Appl. No.: 336,740

[22] Filed: Apr. 12, 1989

[51] Int. Cl.[5] ..... F02M 19/08

[52] U.S. Cl. ..... 261/40; 261/DIG. 57; 261/DIG. 39; 261/78.1

[58] Field of Search ..... 261/DIG. 57, DIG. 39, 261/40, 78.1

[56] References Cited

U.S. PATENT DOCUMENTS

| | | | |
|---|---|---|---|
| 871,134 | 11/1907 | Monnier et al. | 261/DIG. 57 |
| 1,052,051 | 2/1913 | Grimes | 261/40 |
| 1,204,901 | 11/1916 | Plant | 261/40 |
| 1,722,462 | 7/1929 | Gage | 261/16 |
| 1,830,633 | 11/1931 | Barber | 261/78.1 |
| 1,983,255 | 12/1934 | Wahlmark | 261/DIG. 39 |
| 3,664,648 | 5/1972 | Seeley, Jr. | 261/41.1 |
| 3,759,499 | 9/1973 | Lang | 261/41.5 |
| 3,785,627 | 1/1974 | Tuzson et al. | 261/DIG. 39 |
| 3,834,679 | 9/1974 | Baribeau et al. | 261/DIG. 39 |
| 4,046,844 | 9/1977 | Rickert | 261/DIG. 39 |
| 4,055,609 | 10/1977 | Phelps | 261/DIG. 57 |
| 4,235,828 | 11/1980 | Howes | 261/DIG. 57 |
| 4,375,438 | 3/1983 | McKay | 261/DIG. 39 |
| 4,673,536 | 6/1987 | Morris | 261/DIG. 39 |
| 4,751,905 | 6/1988 | Bonfiglioli et al. | 261/78.1 |

*Primary Examiner*—Tim Miles

*Attorney, Agent, or Firm*—Lackenbach Siegel Marzullo & Aronson

[57] ABSTRACT

A main carburetor body has generally cylindrical bores into which are precisely and removably fitted liners. The inner liner surfaces are contoured as a venturi wherein a circular inlet section narrows down to a throat after which the outlet section gradually expands in flow area. Fuel discharges into the venturi through a plurality of ports in the venturi wall, these ports being located around the periphery of the venturi and generally in the vicinity of the venturi throat. Booster venturis, which in conventional carburetors obstruct the flow path, are not used. The carburetor is readily modified by removing the liners and installing a new set of liners which may have different dimensions for the venturi and a different port pattern for fuel inlet to the venturi.

16 Claims, 2 Drawing Sheets

NON-LEAKING VENTURI CARBURETOR

BACKGROUND OF THE INVENTION

This invention relates generally to a carburetor for internal combustion engines for motor vehicles and more particularly to carburetors for racing engines, typically used for racing cars and boats. Carburetors for racing cars are provided with main venturis and booster venturis which are fed with gasoline by a main fuel system during normal engine operation. The booster venturis receive gasoline sprayed into their top portions from primary and secondary discharge nozzles which are activated when the driver accelerates the racing car. An accelerator pump feeds the primary and secondary discharge nozzles.

Racing cars of certain designated classes are provided with carburetors generally having four venturis, or barrels, although carburetors of two venturis, one venturi, and even three venturis are known in the art. Each booster venturi is respectively located within the throat of a main venturi and is sized to conform to a general performance standard. Each race track is configured differently, that is, some are large with gradual turns while others are medium in size and yet others are small with tight turns. Two observations can be made concerning booster venturis on racing cars, especially of the smaller class designations. First, the booster venturis are permanently placed in the main venturis, which are a fixed portion of the carburetor body. Secondly, the booster venturis are designed in accordance with the size of the main carburetor venturi in which it is located and, because race tracks are of various sizes, the booster venturis are designed to give a general response to the racing car coming off turns. Boosters for everyday passenger cars are provided with redesigned, permanently fixed or mounted booster venturis which give the carburetor an average response directed to the average race track. As a result, the horsepower of the engine is not utilized to its potential full capacity. Simply stated, an engine with a fixed booster venturi arrangement is not as efficient as it could be. A car using a carburetor designed for full efficiency on the straightaway may be inefficient and ineffective accelerating out of the turns.

Booster venturis by their location within the main venturi are a disturbance in the airflow patterns, creating turbulence and destroying symmetry. Additionally, it is known that a booster venturi in the carburetor can at times be physically distorted when subjected to intense heat which may be generated in the event of an engine backfire. When a booster venturi becomes distorted, it is usually necessary to remove the main body or housing of the carburetor because the distorted booster cannot be removed and replaced in the carburetor without the aid of special tools.

What is needed is a carburetor for internal combustion engines which improves engine performance efficiency by creating a better fuel input distribution, an improved airflow distribution, and allows quick adaptability to changing track sizes and conditions.

SUMMARY OF THE INVENTION

Generally speaking, in accordance with the invention, a carburetor with peripherally distributed fuel discharge especially suitable for use in high performance internal combustion engines is provided. The main carburetor housing or body is provided with generally cylindrical bores into which are precisely and removably fitted liners, generally of the same material as the body. The liners are generally cylindrical and have a depth corresponding to the body depth. The inner surfaces of the liners are contoured as a venturi, that is, a circular inlet section narrows down to a throat after which the outlet section gradually expands in flow area. The cross sectional areas are circular. Air enters the venturi through the inlet section, accelerates in velocity as the flow area decreases until the air has passed the throat of the venturi.

In accordance with well-known principles of fluid flow, the pressure energy in the relatively slow moving inlet air is converted to velocity energy near the throat and the pressure at the throat drops. It is also known that the narrowest flow path for the air may not occur at the physically most narrow portion of the flow path. Generally, the narrowest actual flow path is downstream of the physical throat. As the pressure within the venturi is reduced, compressibility of air may become a significant factor. Also, there are losses due to turbulences as the air enters the venturis.

Fuel is discharged into the venturi through a plurality of ports in the venturi wall, these ports being located around the periphery of the venturi and generally in the vicinity of the venturi throat where the air pressure is low. The reduced pressure induces flow through the ports from the fuel supply as in a conventional carburetor because of the differential in pressure in the vicinity of the throat relative to the pressure of the fuel supply.

Booster venturis, which in conventional carburetors obstruct the flow path, are not used. An improved uniformity of airflow through the venturi and fuel distribution are achieved in the construction of this invention.

Additionally, for changing track conditions, the carburetor is readily modified by removing the liners and installing a new set of liners which may have different dimensions for the venturi and a different port pattern for fuel input to the venturi.

Accordingly, it is an object of the invention to provide an improved carburetor with peripherally distributed fuel discharge which provides improved performance through more uniform airflow patterns and fuel distribution patterns.

Another object of this invention is to provide an improved carburetor with peripherally distributed fuel discharge having interchangeable venturis, such that many driving conditions can be quickly accommodated.

Still another object of the invention is to provide an improved carburetor with peripherally distributed fuel discharge which is constructed entirely or partially of plastic which is resistant to the fuel.

Still other objects and advantages of the invention will in part be obvious and will in part be apparent from the specification.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
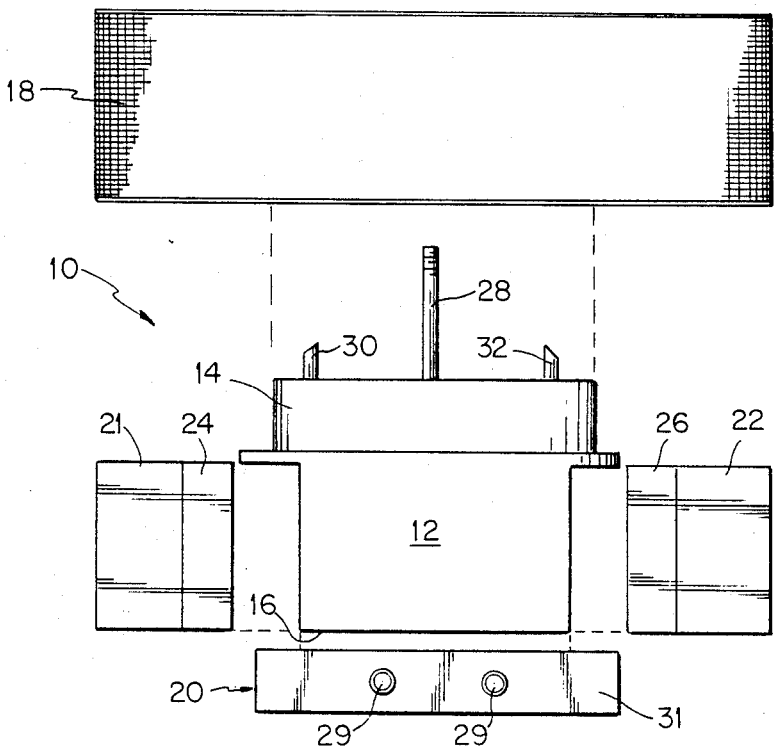
FIG. 1 is an exploded side view of a carburetor assembly in accordance with the invention.

With reference to the Figures, a modular carburetor assembly for an internal combustion engine (not shown), for example, a motor vehicle, especially a racing car, includes a generally cylindrical main carburetor body or housing 12 having opposed top and bottom end surfaces 14, 16, respectively, an air filter 18, a throttle 20 positioned beneath the main body 12, and primary side and secondary side fuel bowls 21, 22, respectively, having fuel metering blocks 24, 26, respectively.

Figure 2:
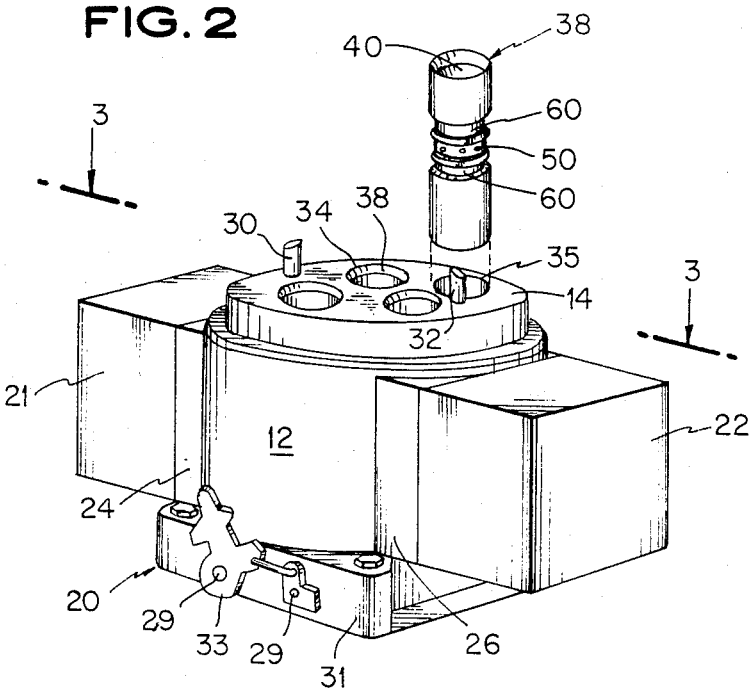
FIG. 2 is a partially exploded top perspective view of the carburetor of FIG. 1.

The fuel is a liquid fuel, more particularly, any fuel used for motor vehicles, for examples, gasoline, methanol. The primary side of the carburetor assembly 10 is forward of the secondary side, that is, the primary side is farthest from the driver of the vehicle. A central stud 28 engages the main housing 12 at the lower end (FIG. 1) of the stud and is used for fastening the air filter 18. A pair of vertical vent tubes 30, 32 are secured to the main housing 12 and connected respectively to the fuel bowls 21, 22 in a conventional manner. For the sake of clarity, the stud 28 is omitted in FIG. 2.

The throttle 20 comprises three major parts. For a four venturi carburetor body 12, there may be typically two shafts 29 connected to throttle plates (not shown) aligned with the venturi openings, and a supporting body 31. A linkage mechanism, indicated generally at 33 (FIG. 2) connects to a foot pedal (not shown) operated by the vehicle driver to move the throttle plates and control the flow of air and therefore fuel through the carburetor 10. The throttle is attached to the carburetor body 12 in any suitable manner.

The air filter 18, fuel bowls 21, 22, metering blocks 24, 26, throttle 20 and linkage mechanism 33 are not considered to be novel portions of the subject invention and, accordingly, are described without substantial detail herein.

Figure 3:
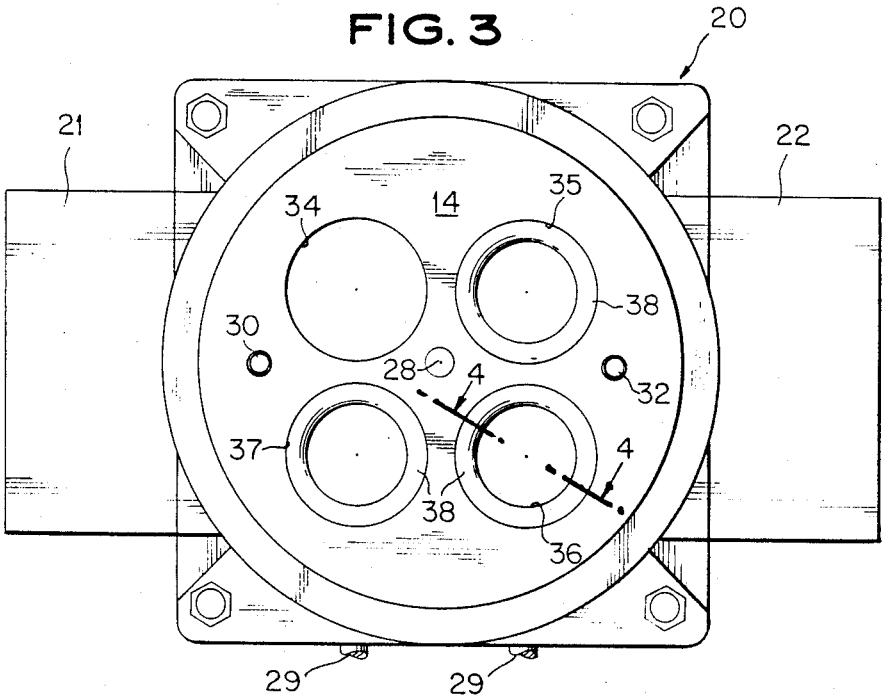
FIG. 3 is a top view of the carburetor taken along the lines 3—3 of FIG. 2.

Four bores 34, 35, 36, 37 extend through the main housing 12 from the top surface 14 to the bottom surface 16. Identical liners 38 are recessed concentrically in the bores 34–37 with a close tolerance fit and extend substantially from the top surface 14 to the bottom surface 16 of the housing 12. For the sake of clarity, the liner 38 which normally would be positioned in the bore 34 is omitted from FIG. 3.

The liners 38 include a through-passage which changes in contour so as to provide a venturi through which air from the filter 18 flows downward (FIG. 4) to the throttle 20. In particular, the venturi 40 within the liner 38 comprises a cylindrical inlet section 42, a converging section 44, and a diverging or expansion section 46. The narrowest dimension of the flow path is the venturi throat 48.

Figure 4:
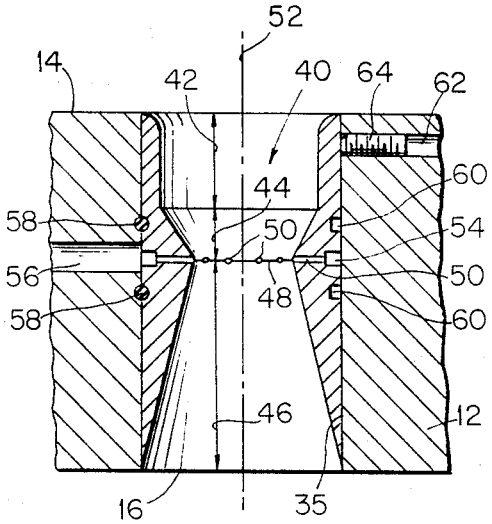
FIG. 4 is a vertical section taken along the lines 4—4 of FIG. 3.

The inner surface of the venturi is pierced by a circular row of spaced apart fuel ports 50. The circle of ports 50 is at a right angle to the longitudinal axis 52 of the venturi liner 38 and located in the vicinity of the venturi throat 48. As illustrated in FIG. 4, the ports are at the narrowest constriction, but need not be limited to this position as discussed more fully hereinafter. The ports 50 extend radially outward from the inner venturi surface toward the outer periphery of the liner 38 and connect into a fuel plenum 54 which is a rectangularly shaped circular groove around the liner 38. A fuel input line 56 in the body 12 connects to the supply of liquid fuel. Fuel is thus supplied to the fuel plenum chamber 54 either under pressure or by suction feed through the ports 50.

Resilient O-rings 58 encircle the liner 38 and are seated in grooves 60 formed into the outer cylindrical surface of the liner 38. The O-rings 58 are of a material which is resistant to the type of fuel used in the carburetor, for example, BUTYL-N rubber, can be used with gasoline generally employed in racing cars. The O-rings 58 are selected and the grooves 60 are dimensioned in accordance with standards set down by O-ring manufacturers to assure a seal between the liners 38 and the bores 34–37 of the housing 12. Thus, all fuel delivered to the plenum through the fuel input line 56 is discharged into the venturi 40 through the ports 50 without escape of fuel at the interface between the liner 38 and housing 12 along the top surface 14 and bottom surface 16.

In FIG. 4, the O-rings 58, which are complete loops, are shown only on the left-hand side of the drawing; the O-rings are omitted from the grooves 60 on the right-hand side of the drawing, again for the sake of clarity in illustration. It should be understood that the O-rings 58 form a complete seal around the liner 38.

In an alternative embodiment in accordance with the invention, O-ring grooves 60 may be formed in the housing bore 35 and the plenum 54 may also be in the housing bore. These grooves are then omitted from the liner 38.

As is well-known, air enters the venturi 40 at the surface 14 with approximate ambient pressure. The velocity of the air accelerates as it passes through the convergent section 44 of the venturi causing a simultaneous drop in air pressure. The air pressure is at its lowest near the throat 48 of the venturi, generally at a location a little below (FIG. 4) the narrowest physical constriction 48. The reduced pressure near the venturi throat causes fuel to be drawn through the ports 50 into the airstream. Fuel is continuously made up in the plenum 54 via the fuel input line 56. The greater is the air velocity at the throat, the lower is the pressure at the throat and the greater is the quantity of fuel flowing through the ports 50. Thus, more fuel flows through the ports 50 when the quantity of air through the venturi 40 is increased or, for a given flow of air, the diameter at the throat 48 is reduced. The desired performance characteristics of a vehicle will determine the particular dimensions which are selected.

The housing 12 as configured can receive interchangeable liners having different physical internal venturi dimensions, while the external dimensions of the different-sized liners 38 remain the same. The liners are reversibly locked in position within the housing 12, for example, by means of a lateral set screw 62 which is threaded into a threaded hole 64 in the housing 12 and is accessible for tightening and release from an exposed side of the housing 12. Thus, loosening the set screw 62 allows the liner 38 to be slipped out of the bore 35. Then, a different liner having different physical dimensions on the inner venturi surfaces can be inserted. Rapid change of performance characteristics for a vehicle is therefore conveniently available. Generally speaking, all four liners will be identical, but liners with different characteristics may be intermixed in the housing 12 under some circumstances.

In FIG. 4, the upper edge of the liner 38 is flush with the housing surface 14. In alternative embodiments (not shown) in accordance with the invention, the upper edge of the liner 38 may be raised above or be sunken below the upper surface 14 of the housing 12. Additionally, the inlet section 42 which is cylindrical, as illustrated, may be reduced in its length in the flow direction, increased in length, and in some instances be completely eliminated. In the latter case, the convergent section 44 begins near the surface 14.

The housing 12 is generally formed of aluminum and the liner 38 may be of the same material, although this is not a necessity. Basically, any rigid materials compatible with the fuel may be used for the housing 12 and liners 38 including plastics. In an alternative embodiment in accordance with the invention, where, for example, housing 12 and liners 38 are formed of plastic, the bores 34–37 need not be circular. In such instances, the outer periphery of the liners 38 are correspondingly shaped. Such construction would tend to inhibit do-it-yourselfers from making replacement liners.

Generally speaking, a quick response for the vehicle comes from smaller diameter venturis which rapidly increase the air velocity and drop the throat pressure rapidly when flow volume is increased and, therefore, quickly provide more fuel.

As illustrated, the ports 50 deliver fuel through openings into the venturi in a direction perpendicular to the longitudinal axis 52. In alternative embodiments in accordance with the invention, the ports 50 may direct the fuel upwardly into the oncoming air or downwardly, or the orientation of the ports 50 may be varied such that some ports point upwardly, others downwardly, and others horizontally.

The ports 50 closest to the fuel inlet 56 may tend to flow more fuel than other ports 50 remote from the inlet 56. This may be compensated by having smaller diameter ports 50 closer to the inlet 56 than elsewhere in the circle of ports 50. Also, barriers can be positioned in the fuel plenum 54 to assure fuel distribution as desired to each port 50. Additionally, a fuel port 50 may be omitted entirely from the circle of ports at the position closest to the fuel input line 56. Desirably, the volume of the fuel plenum 54 is such that velocity effects, wherein the fuel enters the plenum 54 from the input line 56, are dissipated and pressure in the plenum 54 is substantially uniform around the entire annular chamber. Then, uniform fuel flow can be expected from the fuel ports when they are of equal diameter.

As illustrated (FIG. 4), and as stated above, the fuel ports 50 are positioned at the physically narrowest region, the throat 48 of the venturi 40. In alternative embodiments of the carburetor 10 in accordance with the invention, in order to change the response characteristics of the carburetor and the vehicle, the circle of fuel ports 50 is preferably moved to a position slightly below the narrowest constriction 48 of the venturi 40.

Additionally, more than one circular row of fuel ports may be used wherein ports are located either entirely below (downstream) the narrowest constriction 48, or in an arrangement with port rows at the narrowest constriction as well as below. Further, a circle of ports may be located above (upstream) the narrowest constriction at throat 48.

Figure 5A:
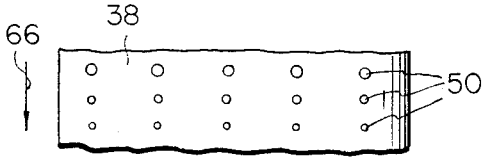
FIGS. 5*a*, 5*b*, 5*c* illustrate alternative port patterns for a venturi in accordance with the invention.
Figure 5B:
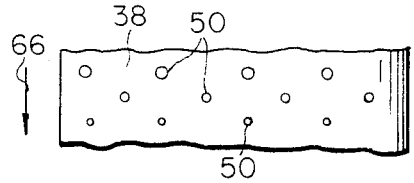
Figure 5C:
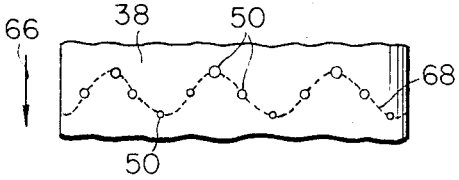

FIGS. 5*a*–5*c* illustrate exemplary patterns of fuel ports 50 which may be utilized in the liners 38, but these illustrations are not to be considered as a limitation to port distribution. FIGS. 5*a*–5*c*, illustrate port patterns as though a venturi 40 was split along a longitudinal line and rolled out to be a flat surface.

FIG. 5*a* illustrates three rows of ports. The arrow 66 indicates the direction of airflow through the venturi. The fuel ports in the row closest to the air inlet have a larger diameter than the fuel ports in the intermediate row, and the fuel ports in the intermediate row have a larger diameter than the fuel ports farther downstream in the airflow. The fuel ports are aligned parallel with the intended direction 66 of airflow.

In FIG. 5*b* the fuel ports 50 are similar to those in FIG. 5*a*, except that they are staggered relative to the next adjacent row. In FIG. 5*c*, the fuel ports 50 are again in three rows with the larger diameter ports closest to the air inlet, the smallest diameter ports farthest from the air inlet, and the intermediate row being of intermediate flow diameter. The ports 50 are positioned as though along an imaginary sine wave 68 in FIG. 5*c*.

The larger fuel ports give power enrichment under wide open airflow conditions. Each row or size of holes may have a separate fuel plenum similar to the plenum 54 with an independent fuel feed similar to the fuel input line 56, or several rows may share one plenum and other rows another plenum. The simplest construction provides a single plenum which feeds all rows of fuel ports.

In a construction where fuel is supplied to the plenum 54 under pressure, the equivalent of fuel injection, the fuel containers 21, 22 can be eliminated.

It should also be understood that in an alternative embodiment in accordance with the invention, where the fuel source is pressurized, the quantity of fuel delivered in response to the driver's actions may depend solely upon the pressure applied to the fuel source. In such a construction, the venturi shape, that is, contraction and then expansion of the airflow, may not be necessary at all, or with a wider throat 48. In other words, if fuel pressure is sufficient to substantially control fuel flow quantity, the reduced pressure in the flow path 40 is a less significant factor.

Also, it should be understood for internal combustion engines and vehicles which are mass produced, such as consumer automobiles, a pattern of fuel ports 50 may be established which satisfies average needs. In such case, the ports 50 and the venturi 40 can be provided integrally with the body 12 without incorporation of the feature of interchangeability of liners 38.

Carburetors in accordance with the invention, have been operated experimentally using gasoline, methanol, and mixtures with good results in the ranges indicated hereinbelow. However, the invention is not limited to these ranges and dimensions. The carburetors had four venturis 40 and were rated in the range of 400 cfm to 2000 cfm. Venturi inlet diameters were in a range of $1\frac{1}{4}$ to 4 inches. Throat diameters were in the range of 40%–90% of inlet diameter. Outlet diameters were in the range of 50%–120% of the inlet diameter. The number of fuel ports 50 in a single circle was in the range from 2 to 30. The port circles were located plus or minus $\frac{1}{2}$ the throat diameter above and below the throat. The lengths of the venturi liner 38 were in the range of 3–7 inches. Fuel port diameters were in the range of 0.010 to 0.100 inches.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed:

1. A carburetor for mixing fuel with air to power an internal combustion engine in controllable fashion comprising:

(a) a carburetor body having at least one bore extending from its first end surface to its second end surface;

(b) a removable liner tightly fitted into each at least one bore having an interior contoured surface forming a venturi tube for laminar flow, and having an inlet section, a throat and an expansion section;

(c) said at least one liner having at its tightly fitting interface with said at least one bore, a plenum for fuel approximately at the throat of the venturi tube and at least a pair of sealing means for preventing leakage of fuel at the interface of the bore and the liner circumferentially surrounding the plenum; and (d) a plurality of fuel ports in each of the at least one liner adapted to lead from the plenum to the inner surface of the venturi tube.

2. A carburetor as in claim 1, wherein the sealing means are O-rings in a cut groove.

3. The carburetor as in claim 1, wherein the plenum and the sealing means are cut into the removable liner.

4. The carburetor as in claim 1, wherein the plenum and the sealing means are cut into the inner surface of the bore.

5. The carburetor as in claim 1, wherein the plenum and the sealing means are cut into both the removable liner and the bore at their interface.

6. The carburetor as in claim 2, wherein the O-ring grooves are positioned one toward the first end surface on one side of the plenum and a second positioned toward the second end surface on the other side of the plenum.

7. The carburetor as in claim 6, wherein the O-ring grooves on each side of the plenum are in fact each a pair of O-ring grooves.

8. The carburetor as in claim 1, wherein the plurality of fuel ports are positioned at different heights of the liner opposite the throat of the venturi tube.

9. The carburetor as in claim 1, wherein the plurality of fuel ports have at least two different diameters.

10. The carburetor as in claim 8, wherein a plurality of fuel ports are positioned opposite the throat of the venturi tube and a plurality of fuel ports are positioned downstream of the throat of the venturi tube.

11. The carburetor as in claim 8, wherein a plurality of fuel ports are positioned opposite the throat of the venturi tube and a plurality of fuel ports are positioned upstream of the throat of the venturi tube.

12. The carburetor as in claim 1, wherein the body of the carburetor has a fuel input line in registry with the fuel plenum.

13. The carburetor as in claim 1, wherein the inlet section of the venturi tube is convergent to the throat section.

14. The carburetor as in claim 1, wherein the expansion section of the venturi tube is divergent.

15. The carburetor as in claim 1, wherein the at least one removable liner has means for releasably maintaining its position in the bore of the carburetor.

16. The carburetor as in claim 15, wherein the releasable means comprises a set screw in a hole tapped in the body of the carburetor.

* * * * *